US006357740B1

(12) United States Patent
Inoue et al.

(10) Patent No.: US 6,357,740 B1
(45) Date of Patent: Mar. 19, 2002

(54) SHEET FEEDING APPARATUS AND IMAGE FORMING APPARATUS

(75) Inventors: Ryukichi Inoue, Abiko (JP); Yoshihiro Matsuo, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/438,488

(22) Filed: Nov. 12, 1999

(30) Foreign Application Priority Data

Nov. 30, 1998 (JP) ..... 10-355345
Apr. 27, 1999 (JP) ..... 11-120700

(51) Int. Cl.[7] ..... B65H 1/10
(52) U.S. Cl. ..... 271/160
(58) Field of Search ..... 271/160

(56) References Cited

U.S. PATENT DOCUMENTS 3,533,617 A 10/1970 Collins
4,165,871 A 8/1979 Yamaguchi
4,613,124 A 9/1986 Lohrmann et al.
5,253,854 A 10/1993 Tanoue et al. ..... 271/10
5,277,418 A * 1/1994 Jones et al. ..... 271/164 X
5,292,116 A 3/1994 Inoue et al. ..... 271/157
5,358,230 A 10/1994 Ikemori et al. ..... 271/114
5,651,540 A 7/1997 Watanabe et al. ..... 271/10.12
5,907,745 A 5/1999 Azuma et al. ..... 399/92
6,039,315 A * 3/2000 Lim ..... 271/160
6,129,348 A * 10/2000 Park ..... 271/160

FOREIGN PATENT DOCUMENTS

EP 0 246 703 11/1987

* cited by examiner

*Primary Examiner*—Christopher P. Ellis
*Assistant Examiner*—Kenneth W Bower
(74) *Attorney, Agent, or Firm*—Fitzpatrick, Cella, Harper & Scinto

(57) ABSTRACT

The present invention relates to a sheet feeding apparatus which has load transmitter for converting a load of a sheet applied to a rear end side in a sheet feeding-out direction of sheet stacker to a biasing force for biasing a leading end side of the sheet stacker toward sheet feeder.

12 Claims, 13 Drawing Sheets

SHEET FEEDING APPARATUS AND IMAGE FORMING APPARATUS

BACKGROUND OF THE INVENTION

1. Field of the Invention

The present invention relates to a sheet feeding apparatus for feeding a sheet to an image forming apparatus, etc.

2. Related Background Art

FIG. 13 schematically shows the sectional construction of a sheet feeding apparatus 300 arranged in an image forming apparatus as a prior art. In FIG. 13, reference numerals 301, 302 and 303 respectively designate a sheet feeding tray receiving (storing) sheets, a middle plate, and a coil spring as a biasing means for biasing the middle plate 302 upward. The middle plate 302 is axially supported by the sheet feeding tray 301 and can stack paper sheets of all sizes which is available by the image forming apparatus.

Reference numerals 304 and 305 respectively designate a separating pad for preventing double feeding of sheets, and a sheet feeding roller. The sheet feeding roller 305 is formed in a fan shape for feeding (sending) out one sheet on the uppermost face of a sheet bundle stacked on the middle plate 302 by frictional force rotated by an unillustrated controlling means.

When a small diameter portion of the fan shape of the sheet feeding roller 305 is opposed to the separating pad 304, a sheet feeding roller 306 separates the separating pad 304 and the sheet feeding roller 305 from each other and is rotatably held so that the sheet feeding roller 306 is rotated in accordance with a movement of the sheet.

The sheet fed from the sheet feeding roller 305 is conveyed by conveying roller pairs 307, 308 arranged in a sheet conveying path 309. These conveying roller pairs 307, 308 further apply conveying force to the fed sheet and convey the sheet even when the rotation of the sheet feeding roller 305 is stopped. The conveying rollers 307 and 308 are respectively a driving roller rotated by driving force, and a conveying roller biased against the conveying roller 307 by an unillustrated biasing means and rotatable around a predetermined axis as a center. Reference numeral 310 designates a feeder frame for holding the sheet feeding roller 305, etc., and attachably and detachably supporting the sheet feeding tray 301.

Reference numeral 311 designates a presence/absence sensor flag for detecting the presence/absence of sheets on the middle plate 302. Presence/absence information of the sheet can be inputted by this presence/absence sensor flag 311 to the image forming apparatus by switching operating states of an unillustrated detecting means. Reference numerals 312 and 313 respectively designate a rear end regulating plate and a side end regulating plate for determining a stacking position of the sheets stacked on the middle plate 302.

However, in the above conventional example, the middle plate 302 has a rotatable one-plate structure supported by a supporting shaft so that the following problems exist.

(1) A weight of the sheets stacked onto the middle plate 302 is greatly changed in accordance with a sheet size. Therefore, force (=sheet feeding pressure) for pressing a sheet by the biasing means for biasing the middle plate 302 against the sheet feeding roller 305 varies, so that the sheet feeding pressure is changed in accordance with the sheet size. Accordingly, it was difficult to stably feed the sheet in accordance with various sheet sizes.

(2) It was also difficult to stably feed the sheet in accordance with various specific gravities since the sheet feeding pressure varies depending on the specific gravities of sheets even when the sheets have the same size.

(3) The above problems (1) and (2) become further notable in the sheet feeding tray of a large capacity in which the number of stackable sheets is large.

There is a case in which it is necessary for a user to adjust or switch the sheet feeding pressure to obtain a required sheet feeding pressure.

SUMMARY OF THE INVENTION

The present invention has been made to solve the above problems inherent in the prior art, and therefore, an object of the present invention is to provide an apparatus for restraining a change in sheet feeding pressure in accordance with the size of a stacked sheet and a specific gravity of the sheet so that the paper can be stably fed.

The present invention is characterized by sheet stacking means rotatably supported by an apparatus body and supporting a sheet;

sheet feeding means arranged on a leading end side in a sheet feeding-out direction of the sheet stacking means and feeding out the sheet supported by the sheet stacking means;

biasing means for pressing the sheet supported by the sheet stacking means against the sheet feeding means; and load transmitting means for converting a load of the sheet applied to a rear end side in the sheet feeding-out direction of the sheet stacking means to a biasing force for biasing the leading end side of the sheet stacking means toward the sheet feeding means.

DESCRIPTION OF THE PREFERRED EMBODIMENTS

Embodiments of the present invention will next be explained.

Figure 1:
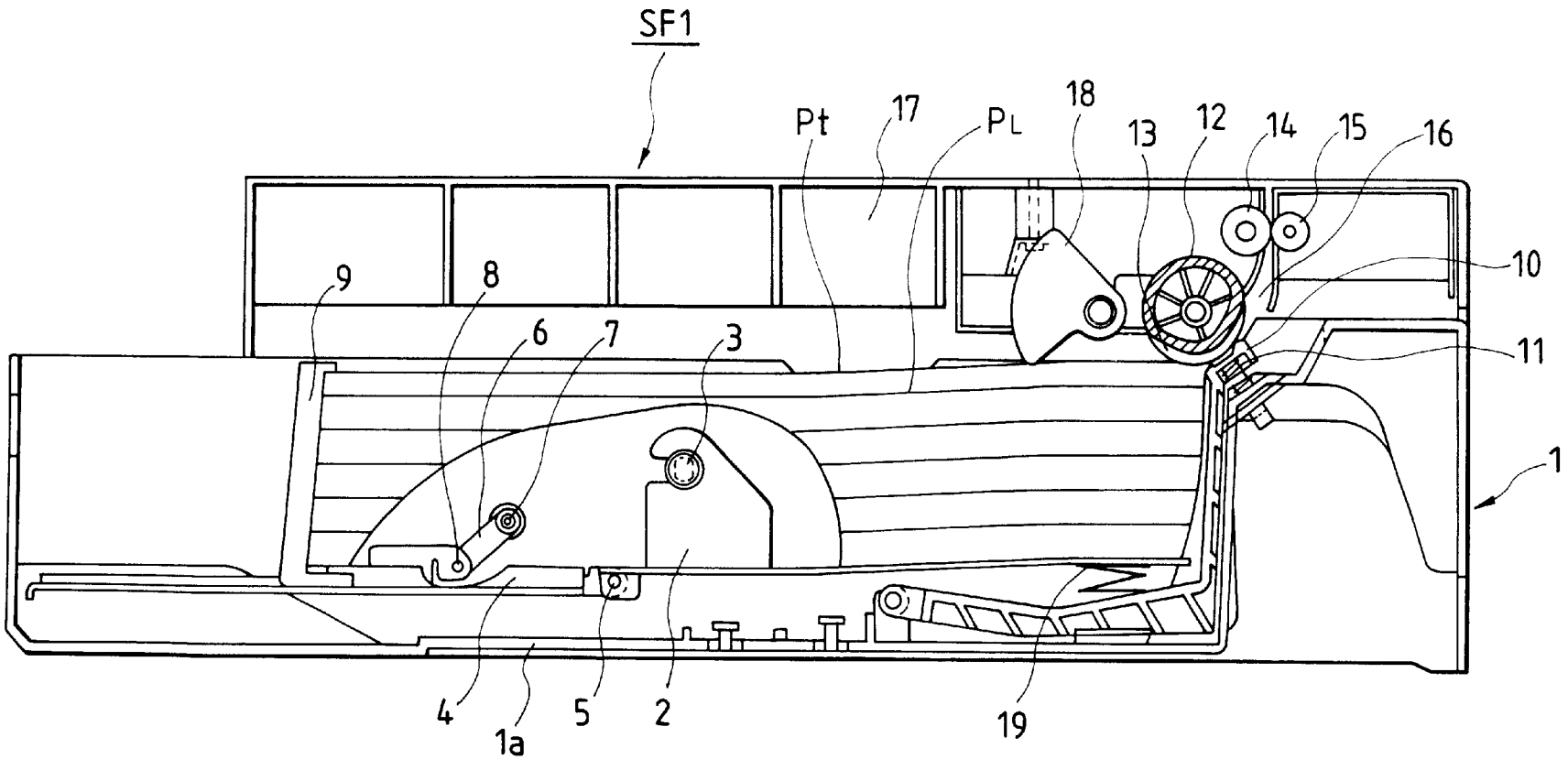
FIG. 1 is a view for explaining the sectional construction of a sheet feeding apparatus in accordance with a first embodiment of the present invention.

FIG. 1 is a view for explaining the sectional construction of a sheet feeding apparatus SF1 to which the present invention is applied. This sheet feeding apparatus SF1 is arranged in a lower portion of an image forming apparatus described later and supplies sheets to an image forming means.

FIG. 1 is a view for explaining the sectional construction of the sheet feeding apparatus SF1 in a state in which a sheet bundle PL of a sheet size (size A4 in Japan and Europe, and letter size in USA) used in most cases is stacked in the sheet feeding apparatus SF1.

In FIG. 1, reference numeral 1 designates a sheet feeding tray (a sheet feeding cassette) detachably attachable to the sheet feeding apparatus SF1 and holding the bundle of sheets to be fed. Reference numeral 2 designates a first middle plate as a first supporting member for supporting one portion of the held sheets. Reference numeral 3 designates a rotary supporting shaft of the first middle plate 2, arranged in a main body 1*a* of the sheet feeding tray 1.

Reference numeral 4 designates a second middle plate as a second supporting member for supporting a predetermined range of the sheets unable to be supported by the first middle plate 2. A connecting joint 5 rotatably connects the first middle plate 2 and the second middle plate 4 to each other. A link arm 6 as a link means functions as a moving means of the second middle plate 4. A round hole 6*a* on one end side of the link arm 6 is rotatably connected to a link shaft 7 arranged in the main body 1*a* of the sheet feeding tray 1 as a fixedly supporting portion. A boss portion 6*b* arranged at the other end of the link arm 6 is rotatably connected to a rotating hole 8 as a part of the second middle plate 4 (the link shaft 7 (the round hole 6*a*) and the boss portion 6*b* (the rotating hole 8) serve as rotating fulcrums of the link arm 6).

In the above construction, a quadric link mechanism is formed by the first middle plate 2, the second middle plate 4 and the link arm 6.

No load of sheets applied to the second middle plate 4 can be transmitted to the first middle plate 2 in a state in which the link arm 6 is set to be vertical. Accordingly, in this embodiment, the link shaft 7 is arranged on a downstream side from the rotating hole 8 in a sheet feeding direction when sheets are fully stacked.

When the link shaft 7 of the link arm 6 is located on a lower side of the second middle plate 4, the link shaft 7 is arranged on an upstream side from the rotating hole 8 in the sheet feeding direction.

Reference numeral 9 designates a rear end regulating member suitably fixed onto the second middle plate 4. The rear end regulating member 9 can be moved by a user to a position in conformity with a paper size and positions rear ends of the sheets. Reference numerals 10, 11 and 12 respectively designate a separating pad for separating overlapped sheets from each other to avoid double feeding, a pad spring for biasing the separating pad, and a sheet feeding roller formed in a fan shape and feeding an uppermost sheet by applying frictional force to this uppermost sheet.

A sheet feeding roller 13 separates the sheet feeding roller 12 and the separating pad 10 from each other and gives only minimum resistance to the sheet being fed by follow movement without any large resistance when a small diameter portion of the fan shape of the sheet feeding roller 12 is opposed to the separating pad 10.

Reference numerals 14, 15 and 16 respectively designate a conveying roller A for further applying conveying force to the fed sheet, a conveying roller A biased by an unillustrated biasing means in a conveying direction of the conveying roller A and pivotally supported so as to be freely rotated, and a sheet feeding conveying path for passing the fed sheet therethrough.

The above members are respectively arranged in a feeder frame 17. Reference numeral 18 designates a presence/absence sensor flag for detecting presence/absence of the sheet on the first middle plate 2. Presence/absence information of the sheet can be inputted by this presence/absence sensor flag 18 to an image forming apparatus by switching operating states of an unillustrated detecting means. Reference numeral 19 designates a middle plate spring for biasing the first middle plate in a feeding direction of the sheet feeding roller 12.

The first middle plate 2 and the second middle plate 4 constitutes a sheet stacking portion in cooperation with each other. The first middle plate 2 supports a predetermined range including a sheet portion pressed against the sheet feeding roller 12 from a leading end side of the sheet in the sheet feeding direction. The first middle plate 2 is also rotated around the rotary supporting shaft 3 as an axis so that the sheet is pressed against the sheet feeding roller 12. The second middle plate 4 supports a predetermined range on a rear end side of the sheet in the sheet feeding direction from the first middle plate 2.

An operation of the sheet feeding apparatus SF1 shown in FIG. 1 will be explained by using FIGS. 2 to 5.

Figure 2:
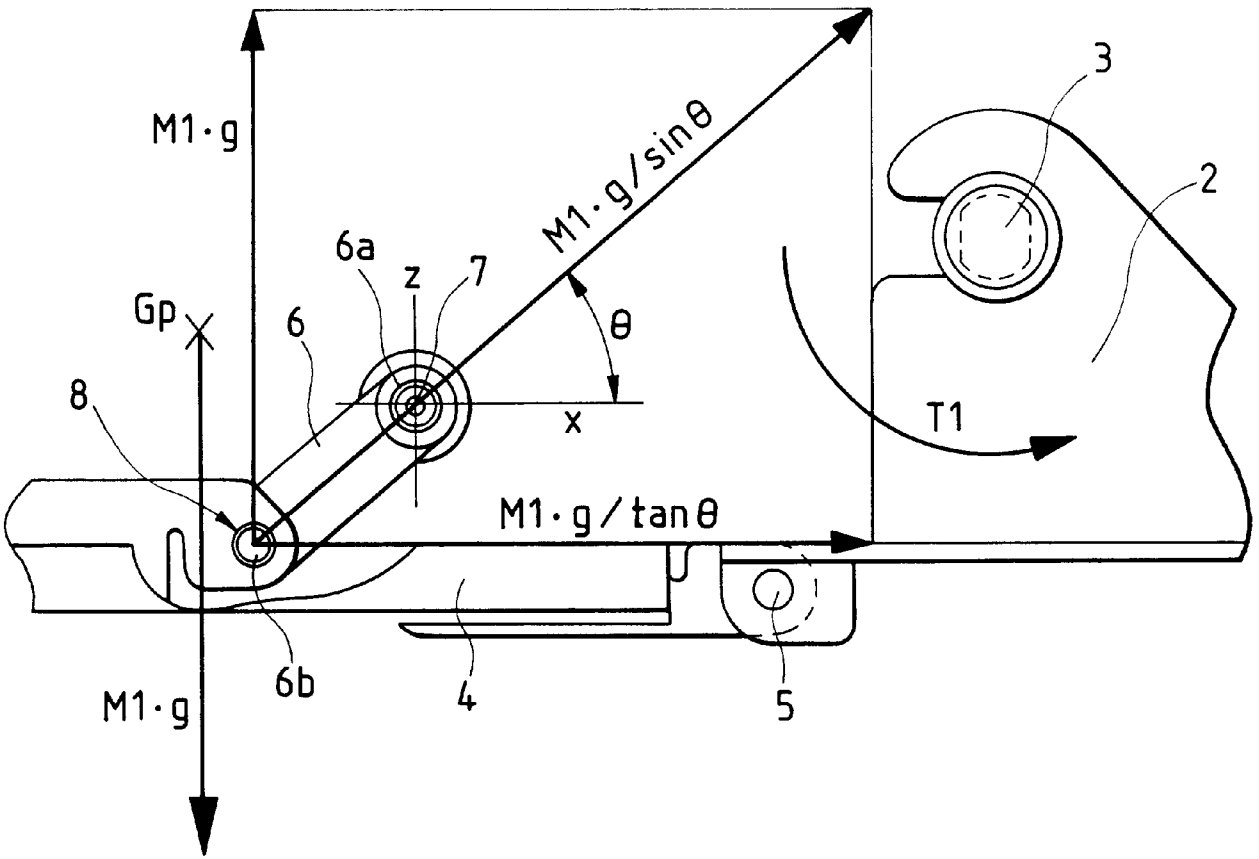
FIG. 2 is a view for explaining an operation of the sheet feeding apparatus in accordance with the first embodiment of the present invention.

Reference numeral Ml in FIG. 2 designates the mass of a portion of a sheet bundle seated on the second middle plate 4 in FIG. 1. Further, reference numerals g, θ and GP respectively designate a gravitational acceleration, an angle of a main shaft of the link arm 6 formed with respect to the horizontal plane, and a center of gravity of sheets seated on the second middle plate 4.

A load is originally also distributed to a portion of the connecting joint 5, and strictly speaking, the load on that portion should be included in calculation. However, this load is minute as compared to the action of force shown in FIG. 2, and does not have any considerable influence on effects of the present invention if this load is not taken into account.

Figure 3:
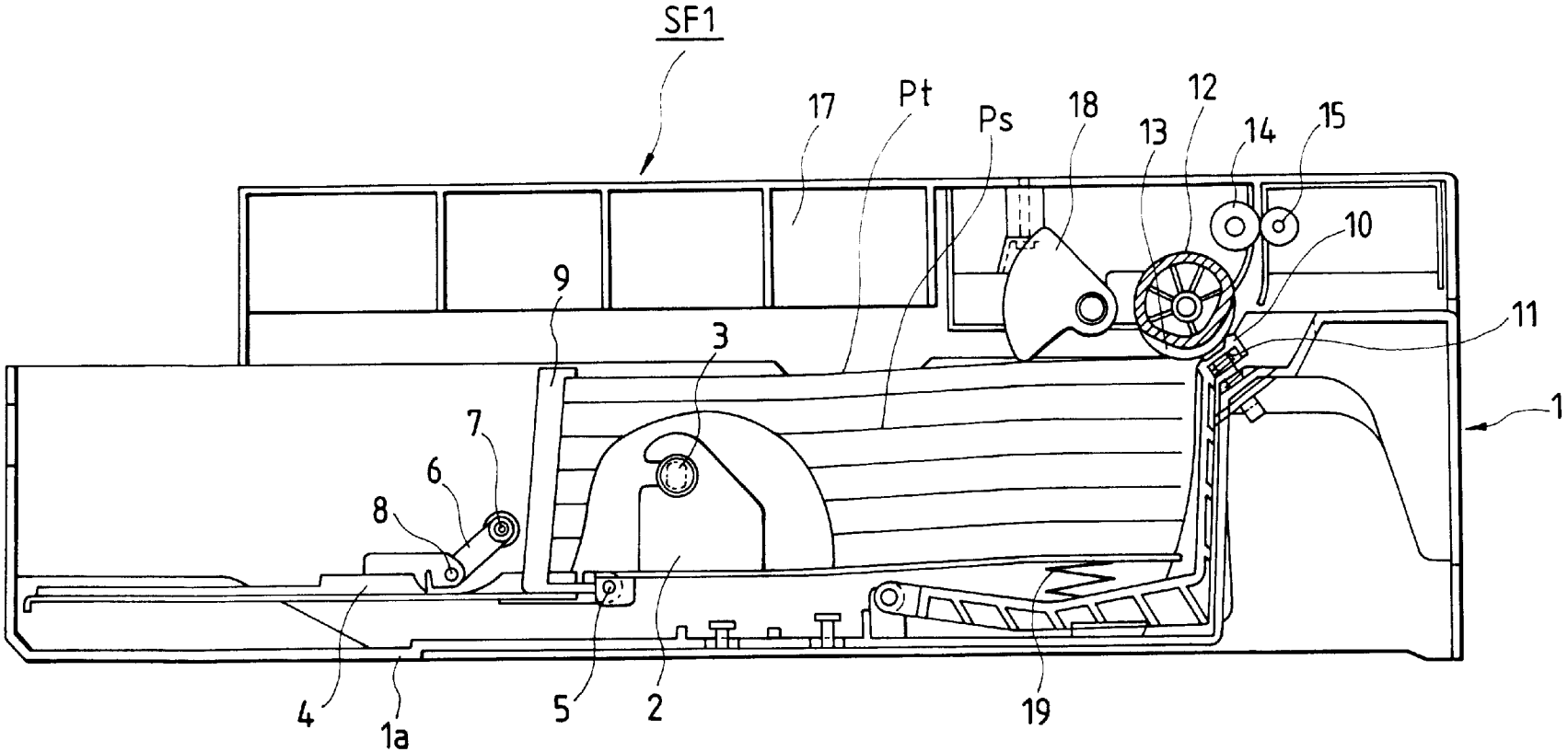
FIG. 3 is a view for explaining the sectional construction of the sheet feeding apparatus in accordance with the first embodiment of the present invention (at a stacking time of the sheet of a small size)
Figure 4:
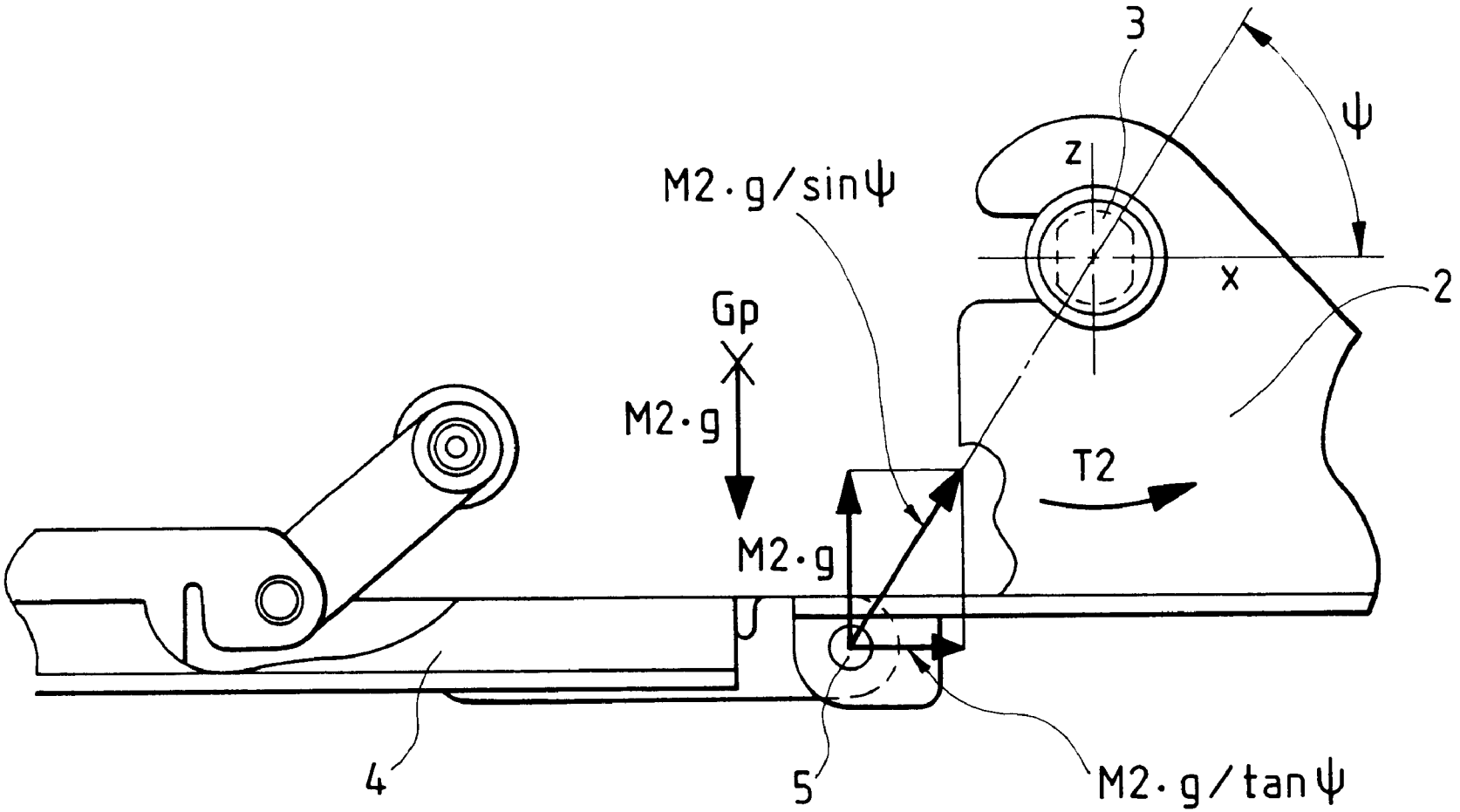
FIG. 4 is a view for explaining the operation of the sheet feeding apparatus in accordance with the first embodiment of the present invention (when stacking sheets of a small size)

FIG. 3 shows a situation when sheets PS of a size smaller than the sheet size shown in FIG. 1 are stacked. Reference numerals in FIG. 3 are the same as in FIG. 1. FIG. 4 is a view showing an operation of the present invention in FIG. 3. In FIG. 4, reference numerals M2 Ψ and respectively designate the mass of a portion of a sheet bundle seated on the second middle plate 4 in FIG. 3, and an angle of a straight line connecting a center of the rotary supporting shaft 3 of the first middle plate 2 and a center of the connecting joint 5 formed with respect to the horizontal plane.

Figure 5:
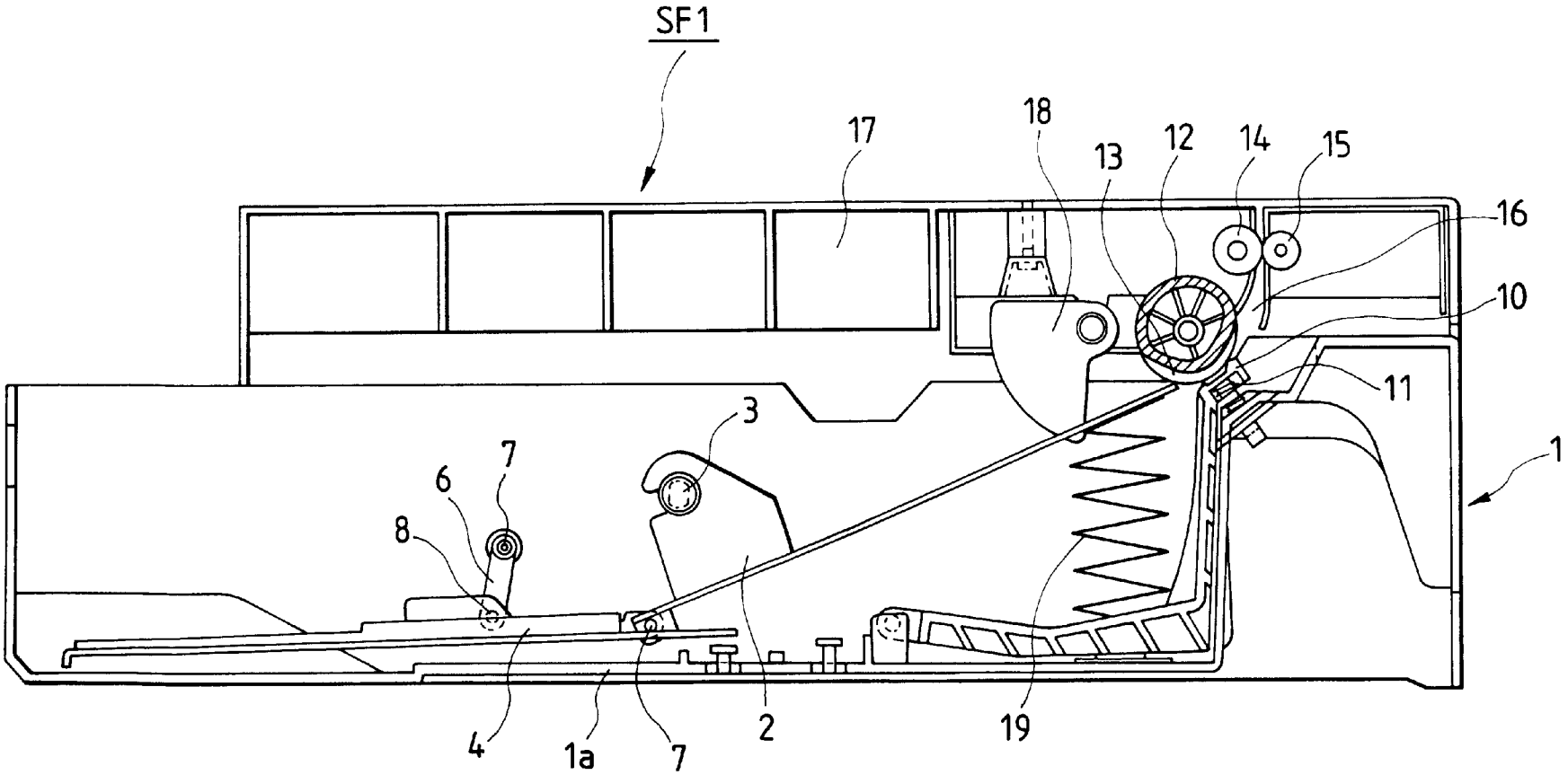
FIG. 5 is a view for explaining the sectional construction of the sheet feeding apparatus in accordance with the first embodiment of the present invention (without sheets stacked thereon)

FIG. 5 shows the sheet feeding apparatus of this embodiment when no sheet is stacked. Reference numerals in FIG. 5 are identical with those in FIG. 1.

With the above construction, a sheet feeding operation is performed as follows.

When it is detected by a posture of the presence/absence sensor flag 18 that a sheet P is put on the first middle plate 2, the sheet P is fed and an image writing operation can be started.

First, the sheet feeding roller 12 begins to be rotated by an unillustrated driver means and a control means. Then, the sheet P (PL or PS) biased upward together with the first middle plate 2 by the middle plate spring 19, etc. comes in contact with the sheet feeding roller 12 and receives feeding force by friction.

A sheet Pt arranged on the uppermost face (uppermost position) begins to be moved by this feeding force in a rightward direction in FIG. 3 and is inserted to the nip between the separating pad 10 and the sheet feeding roller 12.

The separating pad 10 is biased by the pad spring 11 in a feeding direction of the sheet feeding roller 12. Accordingly, advance of sheets except for one sheet on the uppermost face is stopped by frictional force of the separating pad 10, or abutting force at a leading end of the separating pad 10.

The sheet Pt on the uppermost face is further advanced by the frictional force of the sheet feeding roller 12 having a frictional coefficient higher than that of the separating pad 10. A leading end of this sheet Pt is guided by the sheet feeding conveying path 16 and is inserted into a nipping portion of the conveying roller pairs 14, 15 so that the sheet Pt further receives conveying force.

In the meantime, a period for making an outer circumference of the fan shape of the sheet feeding roller 12 come in contact with the sheet Pt is terminated, and the sheet Pt attains a state in which the sheet Pt is nipped in a nipping portion of the sheet feeding roller 13 and the separating pad 10. However, the conveying force of the conveying roller A14 is set to be stronger so that the conveyance of the sheet Pt is continued. Thus, the sheet Pt is conveyed to an unillustrated image forming apparatus.

Next, in the above explanation, force for biasing the sheet PL or PS in the feeding direction of the sheet feeding roller 12 is given by the middle spring 19. However, as shown in FIGS. 2 and 4, the sheet PL or PS is pushed up in the feeding direction of the sheet feeding roller 12 by the dead weight of sheets stacked on the second middle plate 4. This pushing-up operation will next be explained.

First, when long sheets PL as shown in FIG. 1 are stacked, a center of gravity GP of the sheets riding on the second middle plate 4 is located near the link arm 6. In this case, all of a load of the sheets PL applied onto the second middle plate 4 is approximately applied to the link arm 6 from balance of moment of a force.

However, in this case, since the link arm 6 is inclined by the angle θ, tensile force of M1·g/sin θ in FIG. 2 is applied to the link arm.

Force in a horizontal direction given as M1·g/tan θ as resultant force of this load and this tensile force is applied to the first middle plate 2 through the connecting joint 5, so that the posture of the second middle plate 4 is stabilized.

Reaction force to this force in the horizontal direction becomes moment T1 in the counterclockwise direction with the rotary supporting shaft 3 of the first middle plate 2 as a center. Accordingly, the reaction force is applied in a direction in which the first middle plate 2 is rotated in the counterclockwise direction, i.e., the bundle of sheets P is pressed against the sheet feeding roller 12.

A sheet feeding pressure for making the sheet Pt located on the uppermost face come in contact with the sheet feeding roller 12 is determined by a sum of the biasing force of the middle plate spring 19 and reaction force for canceling the above moment T1 (=sheet feeding pressure assistant force).

Next, when short sheets PS as shown in FIG. 3 are stacked, a center of gravity GP of the sheets seated on the second middle plate 4 is located near the connecting joint 5. However, a load of the sheets stacked on the second middle plate 4 at this time is very small in comparison with the case of FIG. 2. In this case, similar to the above case, moment T2 in the counterclockwise direction around the rotary supporting shaft 3 of the first middle plate 2 is generated, but a value of this moment T2 is very small in comparison with the moment T1.

Accordingly, in this case, it may be considered that a pressure for making the sheet Pt located on the uppermost face come in contact with the sheet feeding roller 12 is determined almost by only the biasing force of the middle plate spring 19.

In the above explanation, a state fully laden with the sheets P is explained. However, when the sheets P have the same size, position of the center of gravity of the sheets P stacked on the second middle plate 4 does not depend on a stacked amount of the sheets P, so that the above operation takes place also when the apparatus is not fully lade with the sheets.

However, as the stacked amount of the sheets P is reduced, the angle θ of the link arm 6 is increased. Therefore, a value of 1/tan θ is changed and effects of the action are gradually reduced as the stacked amount of the sheets is changed from a full stacking to a less stacking.

As explained above, the following effects are obtained in the above embodiment.

(1) The sheet feeding pressure assistant force according to the dead weight of a portion of a sheet bundle stacked on the second middle plate 4 is applied to a long sheet PL extending in the sheet feeding direction. The sheet feeding pressure assistant force is reduced as the sheet length in the sheet feeding direction is shortened as in a sheet PS.

Thus, a sheet feeding pressure automatic adjusting function for automatically correcting the sheet feeding pressure can be realized in accordance with the sheet length, so that stable sheet feeding performance with respect to various sheet sizes can be realized.

(2) Even when sheets have the same length, the values of specific gravities of the sheets fluctuate greatly depending on their kinds. When such sheet bundles of various kinds are used, the sheet feeding pressure assistant force reflecting the difference in specific gravity of the sheets is generated by the sheet feeding pressure automatic adjusting function, so that stable sheet feeding performance can be realized.

(3) The sheet feeding pressure automatic adjusting function in the present invention can be applied also to a separating mechanism, as in pad separation or claw separation, in which the sheet feeding pressure effects considerable influence on problems of the sheet feeding such as double feeding and a sheet feeding defect. Accordingly, stable sheet feeding performance can be realized without any sheet feeding pressure adjusting work on the part of a user.

Figure 6:
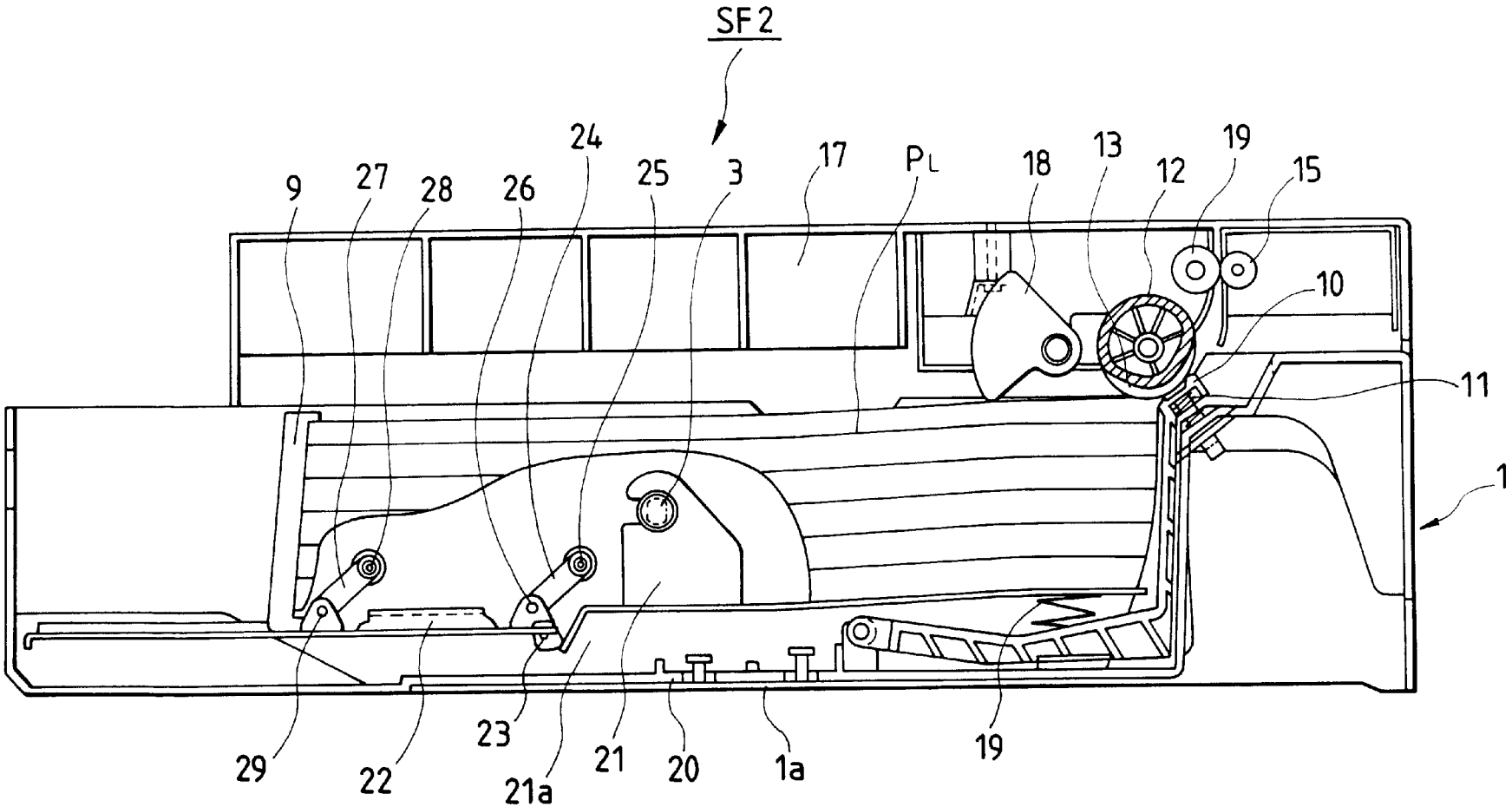
FIG. 6 is a view for explaining the sectional construction of a sheet feeding apparatus in accordance with a second embodiment of the present invention.

A sheet feeding apparatus SF2 in a second embodiment of the present invention will next be explained with reference to FIG. 6. FIG. 6 is a view for explaining a sectional construction of the sheet feeding apparatus SF2. This embodiment is a modified example of the first embodiment.

In FIG. 6, the constructions of reference numerals 9 to 17 and a sheet PL are identical with those in FIG. 1. Therefore, an explanation of these constructions is omitted here.

Reference numerals 20 and 21 respectively designate a sheet feeding tray and a first middle plate rotatably supported by a rotary supporting shaft 3 integrated with the sheet feeding tray 20.

Reference numerals 22 and 23 respectively designate a second middle plate and a dashing (hitting) block as an engaging means coupled to the second middle plate 22. Reference numeral 24 designates a link arm F. A hole on one end side of the link arm F is rotatably fitted to a shaft F25 integrated with the sheet feeding tray 20. A boss on the other end side of the link arm F is rotatably fitted to a side wall hole F26 of the second middle plate 22.

Reference numeral 27 designates a link arm R. A hole on one end side of the link arm R is rotatably fitted to a shaft R28 integrated with the sheet feeding tray 20. A boss on the other end side of the link arm R is rotatably fitted to a side wall hole R29 of the second middle plate 22. Accordingly, the link arms F24 and R27 function as a moving means of the second middle plate 22.

The differences between the first and second embodiments are as follows.

(1) The second middle plate 22 is held by a link mechanism (quadric parallel link) independently of the first middle plate 21.

(2) A sheet feeding pressure assistant force is transmitted by contact of the hitting block 23 and a dashing (hitting) face 21*a* of the first middle plate 21 instead of a shaft coupling portion.

In this embodiment, the following effects can be obtained from the above matters in addition to the effects of the first embodiment.

(1) Since the sheet feeding pressure assistant force is transmitted by the contact of the hitting block 23 and the hitting face 21*a* of the first middle plate 21, an applying direction of the sheet feeding pressure assistant force is directed to a vertical direction on a contact face, so that moment with the rotary supporting shaft 3 as a center is increased even when the sheet feeding pressure assistant force is equal.

(2) Since the second middle plate 22 becomes a quadric parallel link, it is possible to apply the sheet feeding pressure assistant force according to the load of sheets arranged on the second middle plate even when the sheet size is an intermediate length between the lengths of sheets PL and PS.

Figure 7:
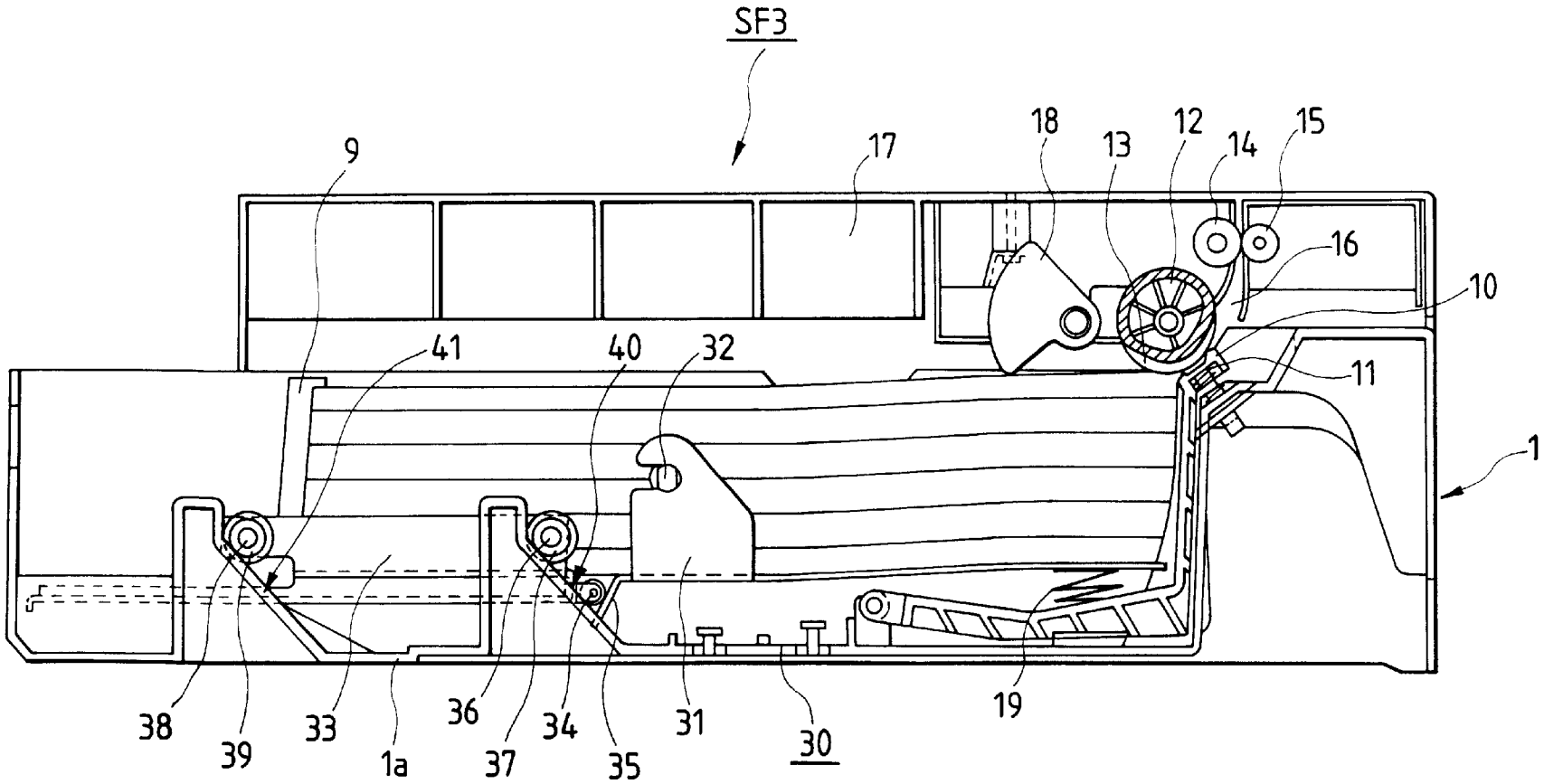
FIG. 7 is a view for explaining the sectional construction of a sheet feeding apparatus in accordance with a third embodiment of the present invention.

FIG. 7 is a view for explaining the sectional construction of a sheet feeding apparatus SF3 showing a third embodiment of the present invention. In this figure, the section of the sheet feeding apparatus SF3 is taken near its side wall on this side in a sheet feeding tray 30. The constructions of a middle plate, etc. near the center of a sheet width are similar to those in FIG. 6. In FIG. 7, the constructions of reference numerals 10 to 19 are equal to those in the first embodiment.

Reference numerals 30, 31 and 32 respectively designate a sheet feeding tray, a first middle plate, and a rotary supporting shaft for rotatably holding the first middle plate 31, formed integrally with the sheet feeding tray 30.

Reference numeral 33 designates a second middle plate. In FIG. 7, a vertical face is formed by bending and rising this second middle plate 33 on this side thereof. An equivalent vertical face is formed in a symmetric position deeper than this vertical face in FIG. 7 although this equivalent vertical face is not illustrated.

Reference numeral 34 designates a dashing (hitting) roller rotatably attached to the second middle plate 33 and is hit against a hitting face 35 projected from the first middle plate 31. Reference numerals 36, 37, 38 and 39 respectively designate a shaft F projected from the second middle plate 33, a position projecting roller F, a shaft R projected from the second middle plate 33, and a position projecting roller R.

Reference numerals 40 and 41 respectively designate a slanting face F positioned and fixed integrally with or separately from the sheet feeding tray 30, and a slanting face R similar to the slanting face F40 (the slanting faces F40 and R41 are arranged on both sides in the width direction of a sheet).

In this embodiment, inclination angles of the slanting faces F40 and R41 are set to be equal to each other, but it is clear that similar effects are obtained even when the inclination angles are different from each other, and characteristics are different but.

Accordingly, the second middle plate 33 is held by a sliding means functioning as a moving means having the above construction.

Figure 8:
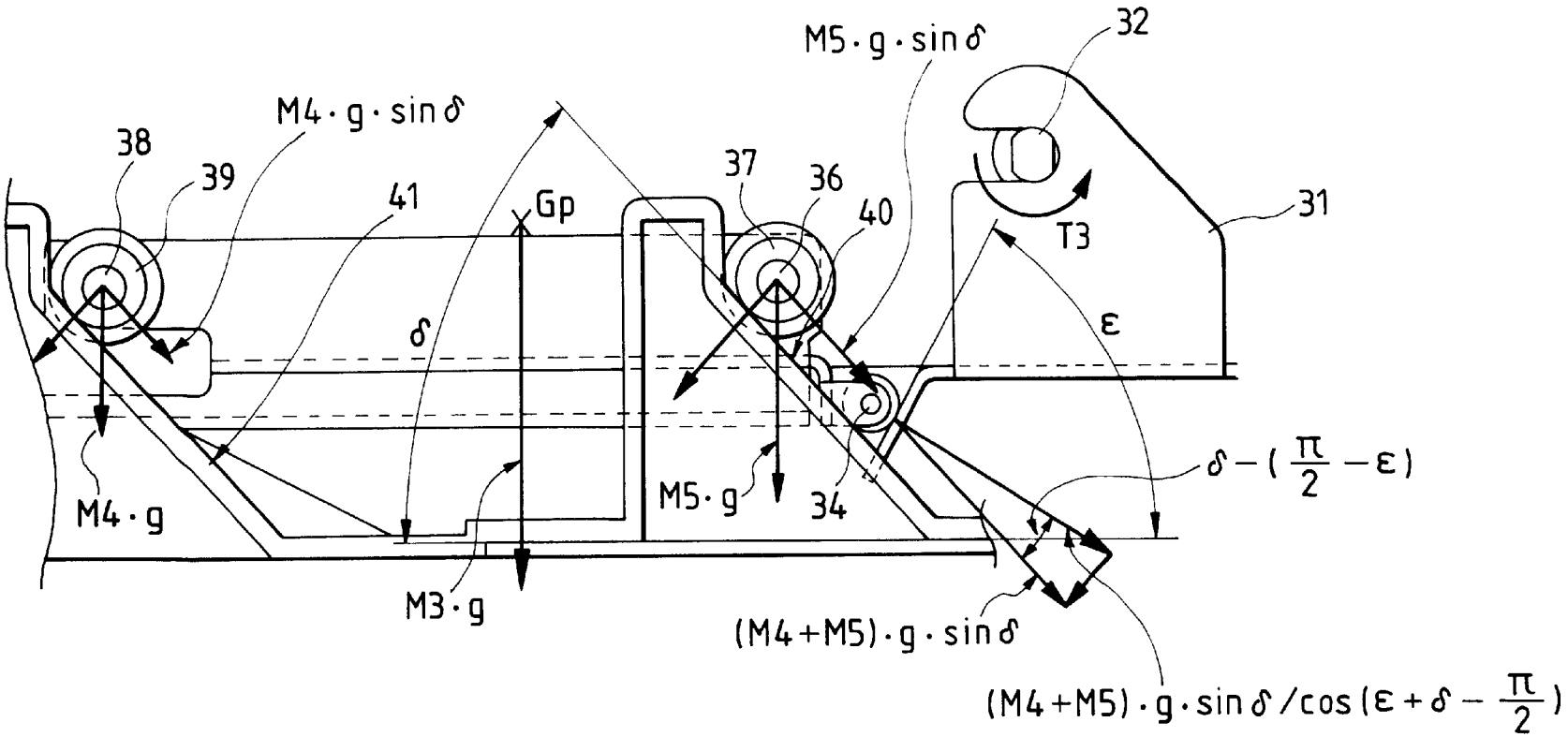
FIG. 8 is a view for explaining an operation of the sheet feeding apparatus in accordance with the third embodiment of the present invention.

FIG. 8 is a view showing an operation of the sheet feeding apparatus in this embodiment. In this figure, reference numerals M3, M4 and M5 respectively designate the mass of a sheet bundle stacked on the second middle plate 33, a mass component of the sheet bundle applied to the position projecting roller R, and a mass component of the sheet bundle applied to the position projecting roller F.

Reference numerals $\delta$ and $\epsilon$ respectively designate an inclination angle of each of the slanting faces F40 and R41 with respect to the horizontal plane, and an inclination angle of the hitting face 35 with respect to the horizontal plane. The other reference numerals are similar to those in FIG. 2.

A sheet feeding operation in the above construction is similar to that in the first embodiment. This embodiment is characterized in a pressurizing method of a sheet feeding assistant pressure.

As shown in FIG. 8, a load distributed in accordance with a distance from a center of gravity GP of paper is generated in each of the position projecting rollers F37 and R39. This load is applied to each of the slanting faces F40 and R41. Therefore, it is necessary from component force shown in FIG. 8 to receive external force of $(M4+M5)\cdot g\cdot \sin\delta = M3\cdot g\cdot \sin\delta$ in a slanting face direction so as to maintain a posture of the second middle plate 33.

This external force is transmitted by contact of the hitting roller 34 and the hitting face 35. When the difference between the inclination angle $\delta$ of the slanting faces F40 and R41 and an angle $(\pi/2-\epsilon)$ formed by the horizontal plane and a virtual line of an inclination face of the hitting face 35 in a vertical direction is set to $\delta-(\pi/2-\epsilon))=\Delta$, contact force FC at a contact point of the hitting roller 34 and the hitting face 35 is provided as follows.

$$FC=M3\cdot g\cdot \sin\delta/\cos\Delta$$

Thus, moment T3 in the counterclockwise direction with the rotating fulcrum 32 as a center is generated and a sheet feeding pressure assistant force according to the load of a sheet bundle stacked on the second middle plate is generated.

Characteristic effects in this embodiment are as follows.

(1) The load of stacked sheets and the sheet feeding pressure assistant force have a proportional relation except for a factor of 1/cos Δ irrespective of an amount of the sheets stacked on the second middle plate 33.

When the above factor 1/cos Δ is calculated in this embodiment mode, this factor becomes 303 at the time of full stacking and 1.41 at less stacking. Accordingly, a change in this factor is very small in comparison with changes in the first and second embodiments (change factor: in 1/tan θ, 1 at the time of full stacking and 0 at less stacking in FIG. 1 of the first embodiment). Accordingly, it is possible to apply stable sheet feeding pressure assistant force irrespective of the stacked amount.

(2) Since shapes of the slanting faces F and R can be freely determined, the inclination angle can be selected and a curved slanting face, etc. can be also adopted, so that a degree of freedom in design of the sheet feeding pressure assistant force is high.

(3) Since the second middle plate 33 is arranged on the slanting faces F and R, an assembly property is preferable.

Figure 9:
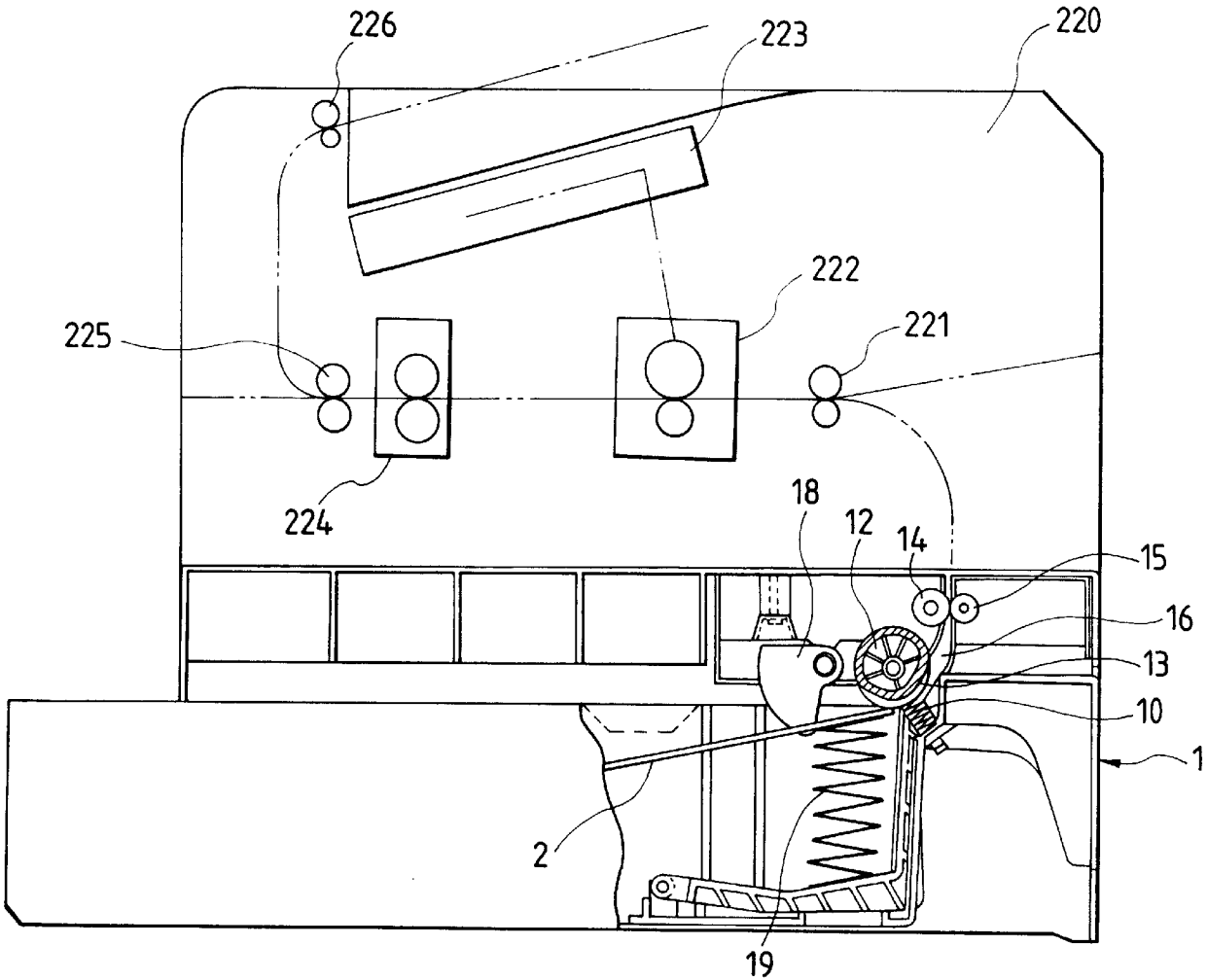
FIG. 9 is a view for explaining the sectional construction of an image forming apparatus having the sheet feeding apparatus in accordance with the first to third embodiments of the present invention.

One example of an image forming apparatus having the sheet feeding apparatus of the above embodiment mounted thereto will next be explained by using FIG. 9.

The sheet feeding apparatus of the present invention is mounted to a lower side of an image forming apparatus 220. Reference numerals 221, 222, 223 and 224 respectively designate a conveying roller pair B for conveying paper, a drum-transfer roller pair for transferring an image onto a sheet, a laser scanner unit for writing a latent image onto a drum, and a fixing unit for fixing the transferred latent image onto the sheet. Reference numerals 225 and 226 respectively designate discharging roller pairs A and B for discharging the sheet on which the image has been formed to the exterior of the image forming apparatus.

In the above construction, a sheet feeding operation and image formation are performed as follows. When it is detected by the posture (rotation position) of an existence sensor flag 18 that sheets P are stacked on a middle plate 2, the sheet feeding operation and subsequent image writing can be started.

First, a sheet feeding roller 12 begins to be rotated by an unillustrated driving means and a control means. Then, the sheets biased upward together with the middle plate 2 by a biasing means 19 receive frictional force by the sheet feeding roller 12.

A sheet Pt located on the uppermost face begins to be moved by this frictional force in a rightward direction in this figure and is inserted into a nipping portion of a separating pad 10 and the sheet feeding roller 12. The separating pad 10 is biased by the biasing means in a feeding direction of the sheet feeding roller 12. Accordingly, the advance of sheets except for one sheet on the uppermost face is stopped by the frictional force of the separating pad 10 or abutting force at a leading end of the separating pad 10.

The sheet Pt on the uppermost face is further advanced by the frictional force of the sheet feeding roller 12 having a frictional coefficient higher than that of the separating pad 10, and a leading end of this sheet is guided by a sheet feeding conveying path 16. Thus, the sheet Pt is inserted into a nipping portion of a conveying roller A14 and a conveying roller A15 and further receives conveying force.

In the meantime, a period for making an outer circumference of a fan shape of the sheet feeding roller 12 come in contact with the sheet Pt is terminated, and the sheet Pt is nipped in a nipping portion of a sheet feeding roller 13 and the separating pad 10. However, conveying force of the conveying roller A14 is set to be stronger, so that the conveyance of the sheet Pt is continued.

The sheet being conveyed is next inserted into a nipping portion of the conveying roller pair 221 and further receives conveying force. A latent image written onto a drum by the laser scanner unit 223 is developed by an unillustrated developing means and is then transferred to the sheet Pt inserted into a nipping portion of the drum-transfer roller pair 222.

The image is fixed to the sheet Pt by the fixing unit 224. Thereafter, this sheet Pt is discharged to the exterior of the image forming apparatus by rotating the discharging roller pairs A225, B226. Thus, the image is formed on the sheet.

A fourth embodiment of the present invention will next be explained with reference to FIGS. 10 to 12.

An image forming apparatus having a sheet feeding apparatus of this fourth embodiment will first be explained with reference to FIG. 12. In this explanation, a laser beam printer is used as an example of this image forming apparatus.

Figure 12:
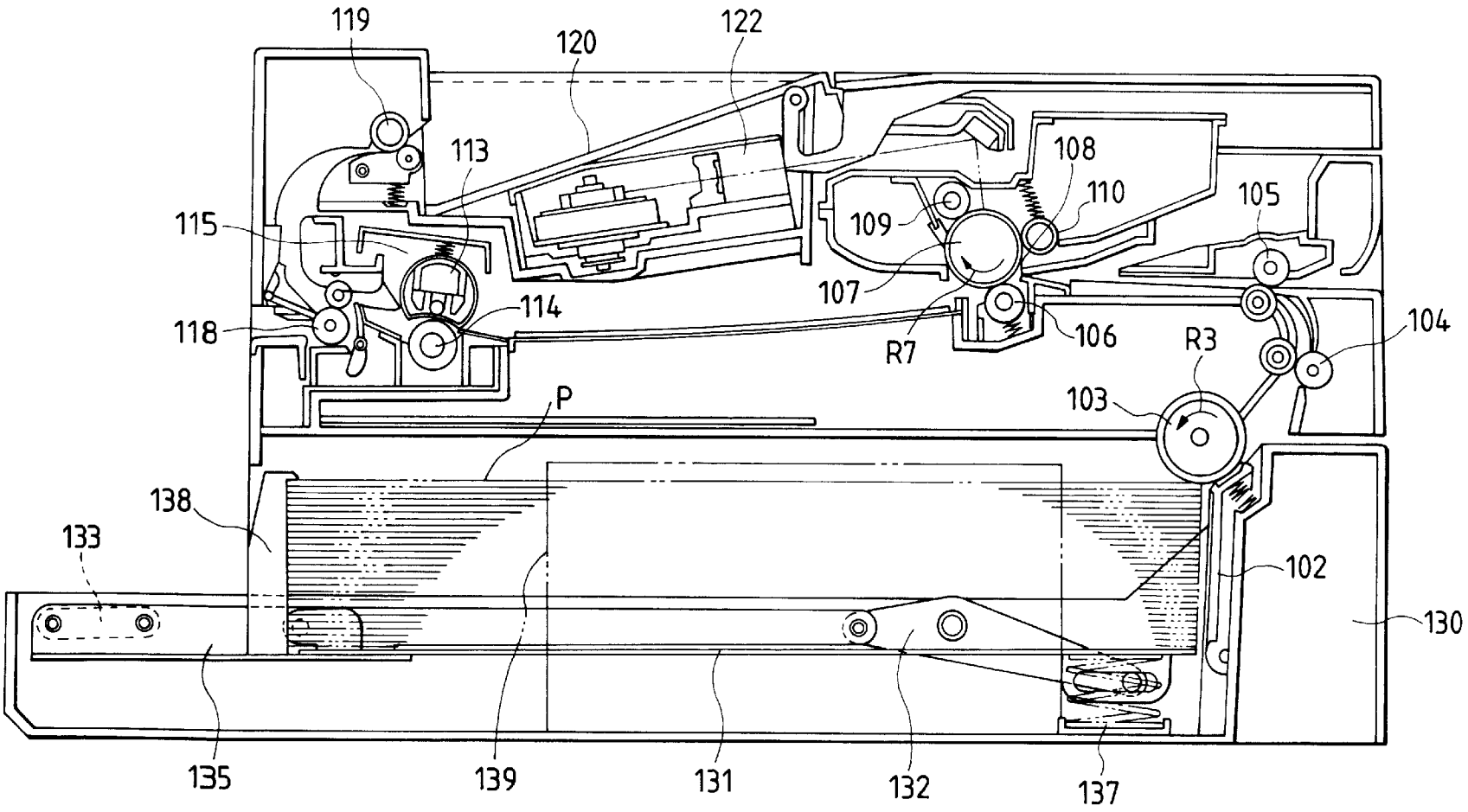
FIG. 12 is a view for explaining the sectional construction of an image forming apparatus having the sheet feeding apparatus in accordance with the fourth embodiment of the present invention.
Figure 13:
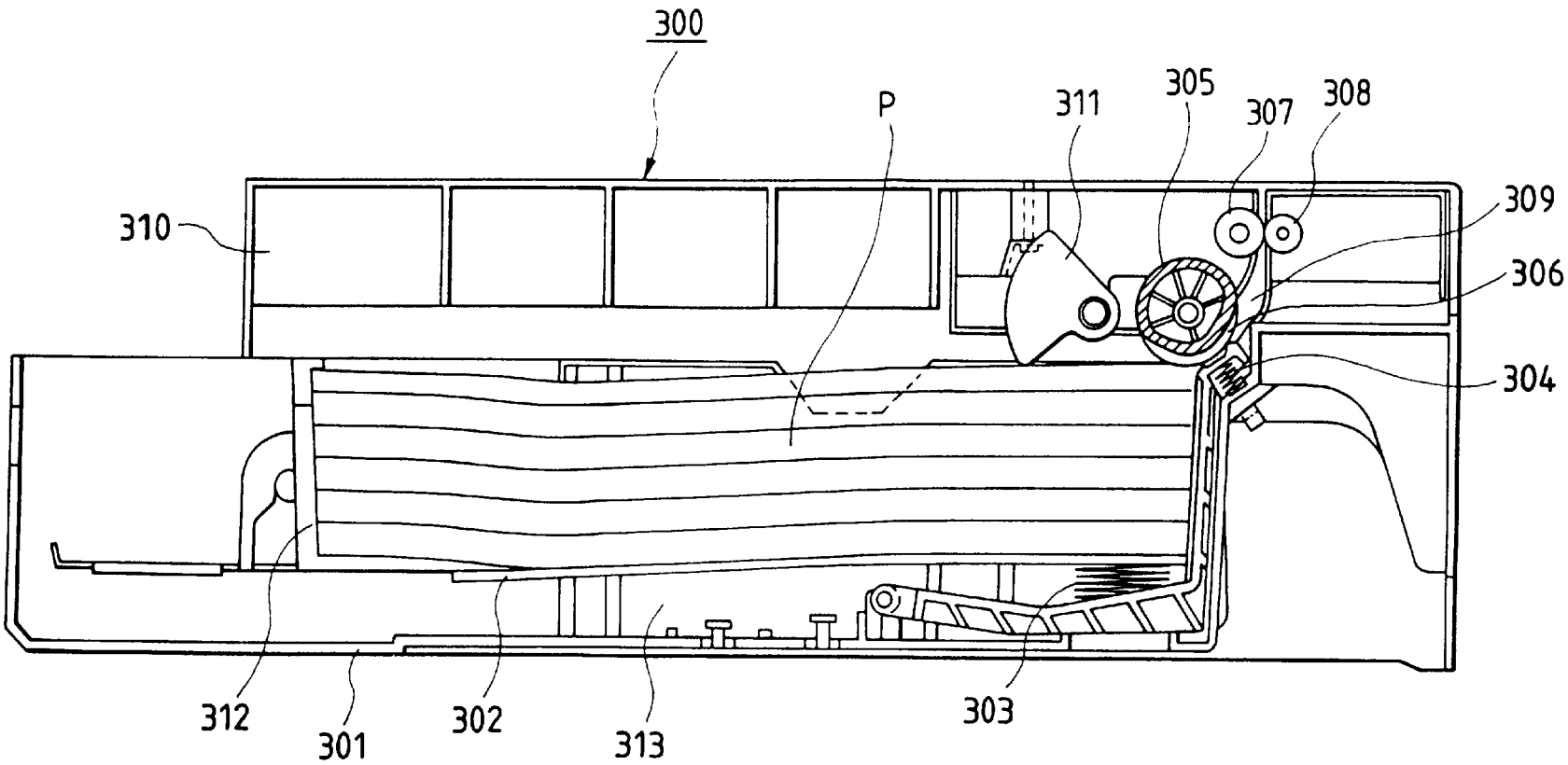
FIG. 13 PRIOR ART
FIG. 13 is a view for explaining the sectional construction of a conventional sheet feeding apparatus in a state in which sheets are stacked in the conventional sheet feeding apparatus.

In FIG. 12, reference numeral 120 designates a laser beam printer as the image forming apparatus. A sheet feeding tray 130 as a cassette body is mounted to his laser beam printer 120 and plural sheets P are stacked on this sheet feeding tray 130. A sheet feeding roller 103 rotated only at a sheet feeding time is arranged in a sheet feeding port of the laser beam printer 120. The sheets P are fed from the sheet feeding tray 130 when this sheet feeding roller 103 is rotated in the direction of an arrow R3 in FIG. 12 (in the counterclockwise direction). The sheets P fed by the sheet feeding roller 103 are separated one by one by a separating means 102 and are conveyed to an image forming section by a conveying roller pair 104 and a registration roller pair 105.

The laser beam printer 120 has the conveying roller pair 104 for conveying the sheets P, the registration roller pair 105, a toner image transfer section 108 as the image forming section, a developing unit 110, a transfer roller 106, and a fixing device 115. The toner image transfer section 108 transfers a toner image to the sheets P guided by this registration roller pair 105. The developing unit 110 visualizes an electrostatic latent image on a photosensitive drum 107 constituting this toner image transfer section 108. The transfer roller 106 transfers the toner image visualized on the photosensitive drum 107 to the sheet P. The fixing device 115 fixes the toner image onto the sheets P.

The sheets P is fed from the sheet feeding tray 130 by the sheet feeding roller 103 and is separated one by one by the separating means 102 and is guided to the toner image transfer section 108 by the conveying roller pair 104 and the registration roller pair 105.

The photosensitive drum 107 is rotated in the direction of an arrow R7 in FIG. 12 (in the clockwise direction), so that the photosensitive drum 107 is uniformly charged by a charger 109. Thereafter, the photosensitive drum 107 is exposed to a selective laser beam based on an image signal and emitted from a laser scanner 122 so that an electrostatic latent image is formed. This electrostatic latent image on the photosensitive drum 107 is visualized (as a toner image) by the developing unit 110.

Next, the toner image formed on the photosensitive drum 107 is electrically attracted by the transfer roller 106, so that the toner image is sequentially transferred to the printing face (an upper face in FIG. 12) of the sheets P passing through the toner image transfer section 108. Thus, the toner image is formed on the sheets P.

Thereafter, the sheets P are guided to a nipping portion of a heating means 113 of the fixing device 115 and a pressurizing roller 114 coming in press contact with this heating means 113. The toner image transferred onto the sheet face in a process in which the sheet P passes through the nipping portion is heated and pressurized. Thus, the toner image is fixed onto the sheet face.

The sheet P passing through the fixing device 115 is discharged by discharging rollers 118, 119 onto a paper discharging tray 121 through a paper discharging path 116.

A sheet feeding apparatus SF4 in this embodiment will next be explained with reference to FIGS. 10 and 11.

Figure 10:
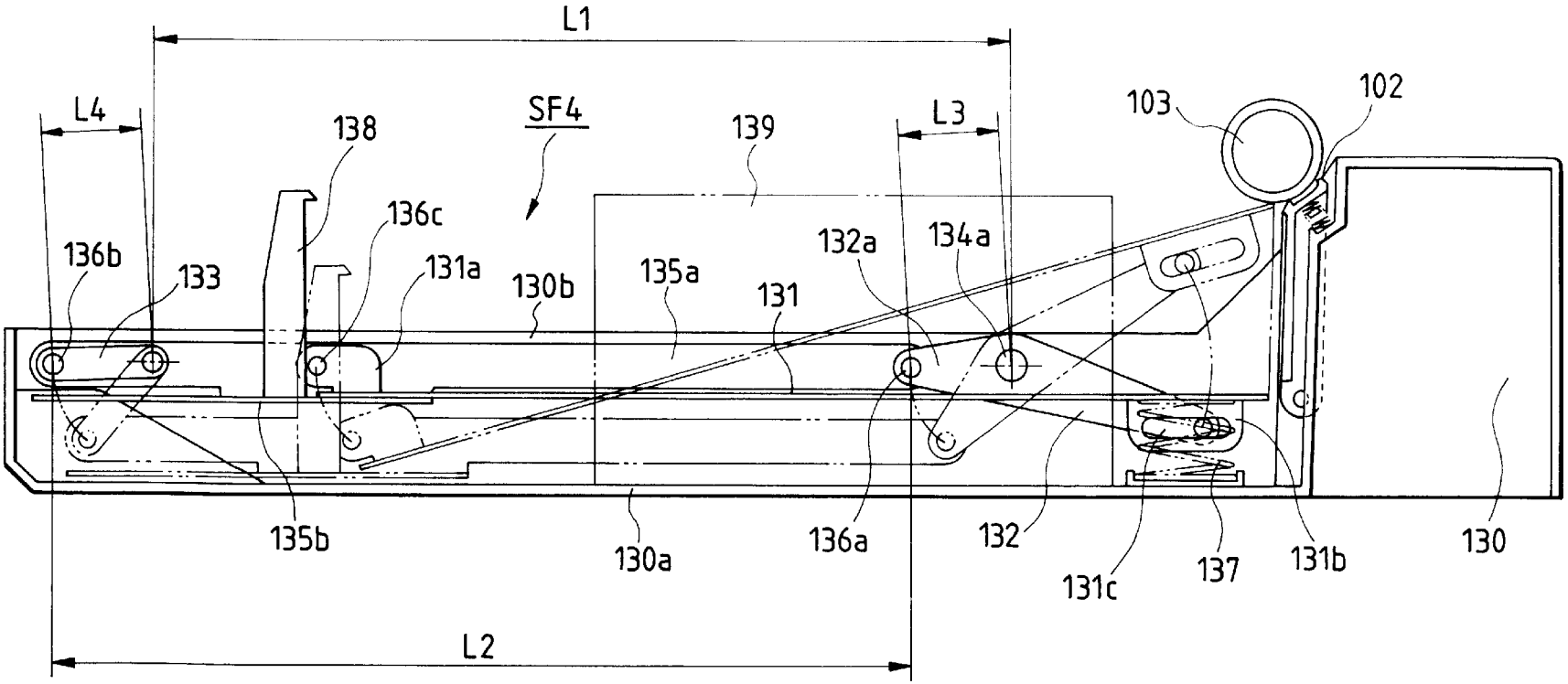
FIG. 10 is a view for explaining the sectional construction of a sheet feeding apparatus in accordance with a fourth embodiment of the present invention.
Figure 11:
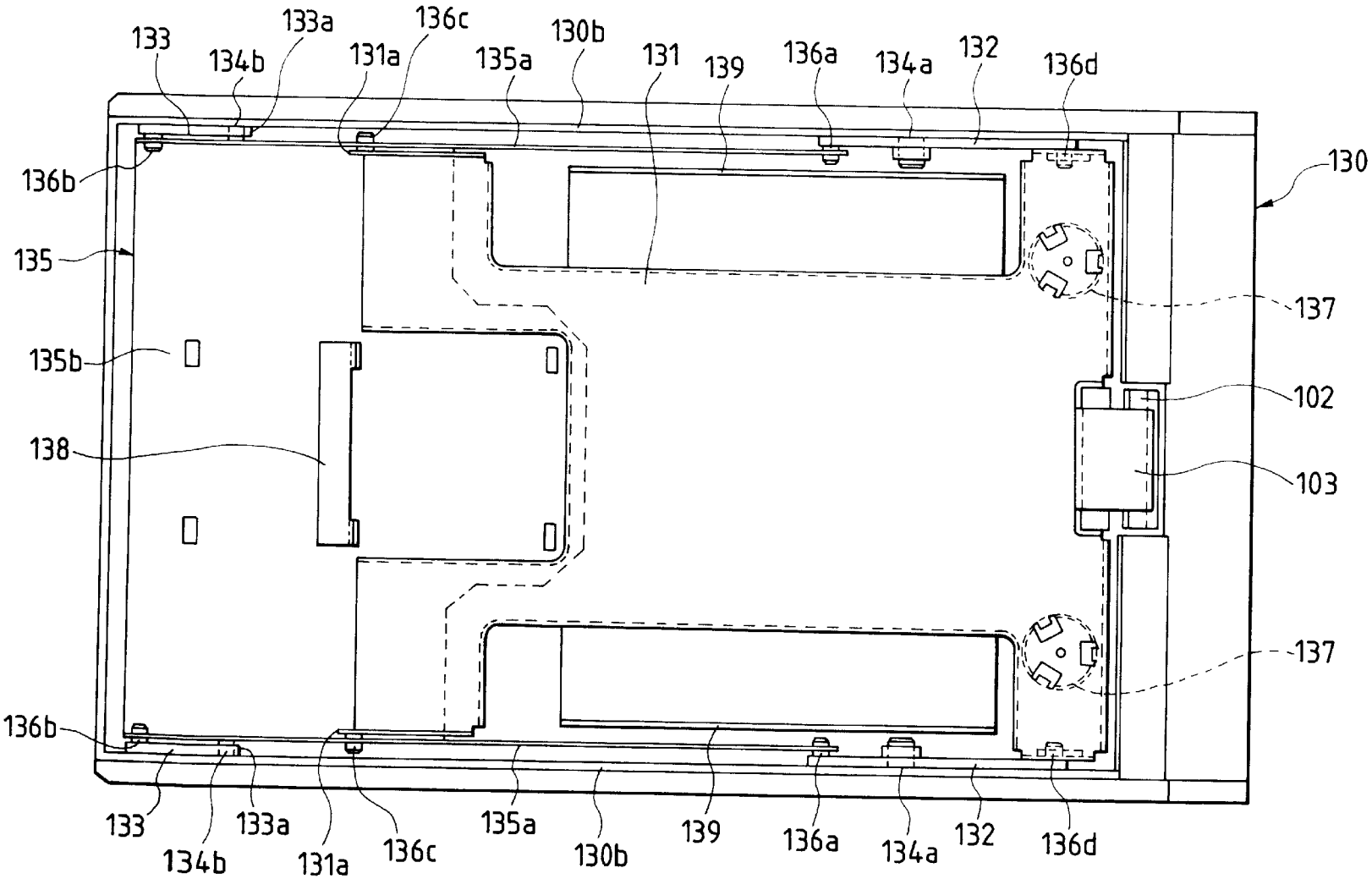
FIG. 11 is a plan view of the sheet feeding apparatus in accordance with the fourth embodiment of the present invention.

In FIG. 10, a load transmitting member 132 and an arm member 133 are arranged on both left-hand and right-hand sides of the sheet feeding tray 130 with respect to a middle plate 131. An intermediate portion 132*a* of the load transmitting member 132 is pivotally supported with a shaft 134*a* at a side wall 130*b* of a main body 130*a* of the sheet feeding tray 130 on its leading end side. Similarly, a leading end portion 133*a* of the arm member 133 in its paper passing direction is rotatably supported at the side wall 130*b* with a shaft 134*b*.

A load receiving member 135 is arranged within the sheet feeding tray 130 and is integrally formed by continuously arranging a rising portion 135*a* arranged along left-hand and right-hand side walls of the sheet feeding tray 130 by a plane portion 135*b*. A leading end portion of the load receiving portion 135 and a rear end portion of the load transmitting member 132 are pivotally supported by a connecting shaft 136*a*. A rear end portion of the load receiving member 135 and a rear end portion of the arm member 133 are pivotally supported by a connecting shaft 136*b*. Further, a rear end side supporting portion 131*a* of the middle plate 131 is axially supported by a connecting shaft 136*c* in an intermediate portion of the load receiving member 135.

For example, the middle plate 131 has a sheet stacking face having a length close to a standard sheet size such as size A4 and the letter size, in a paper passing direction. A leading end side supporting portion 131*b* is arranged at a leading end of the middle plate 131 in the paper passing direction. An elongated hole 131*c* is formed in this leading end side supporting portion 131*b*, and a shaft 136*d* arranged in a leading end portion of the load transmitting member 132 is slidably inserted with play into this elongated hole 131*c*. Springs 137, 137 are arranged as a biasing means for pushing the middle plate 131 upward on a leading end side of the sheet feeding tray 130 in the paper passing direction. When sheets P of a standard size are stacked on the middle plate 131, the weight of the sheets P is approximately uniformly distributed to the leading end side supporting portion 131*b* and the rear end side supporting portion 131*a*.

A rear end regulating member 138 is movably arranged on the plane portion 135*b* along the paper passing direction. This rear end regulating member 138 can be moved in the paper passing direction in accordance with a sheet size. A width regulating member 139 regulates a width direction position of the sheets P stacked on the middle plate 131. This width regulating member 139 is movably supported in a width direction of the main body 130*a* of the sheet feeding tray 130.

In this embodiment, a distance L1 from the shaft 134*a* to the shaft 134*b* is equal to a distance L2 from the connecting shaft 136*a* to the connecting shaft 136*b*. A distance L3 from the shaft 134*a* to the connecting shaft 136*a* is equal to a distance L4 from the shaft 134*b* to the connecting shaft 136*b*. The connecting shaft 136*a* is located backward from the shaft 134*a* in the paper passing direction and is rotated in the range of a lower side. The connecting shaft 136*b* is located backward from the shaft 134*b* in the paper passing direction and is rotated in the range of a lower side. The connecting shafts 136*a* and 136*b* constitute a parallel link mechanism. Thus, the load receiving member 135 maintains a horizontal state and is moved in parallel. Further, the shaft 136*d* is moved in the range of a leading end side from the shaft 134*a* in the paper passing direction.

Namely, the connecting shaft 136*a* and the shaft 136*d* are separated by predetermined distances from the shaft 134*a*. An angle θ formed by a line connecting the connecting shaft 136*a* and the shaft 134*a* and a line connecting the shafts 134*a* and 136*d* is set to a predetermined angle (in a range of from 90 to 180 degrees). Thus, a leading end side of the middle plate 131 can be rotated in a vertical direction with the connecting shaft 136*c* as a center as the load receiving member 135 constituting the link mechanism is moved in parallel. Accordingly, as the number of stacked sheets P is reduced, the middle plate 131 is rotated by the springs 137, 137 to reach the state indicated by a two-dotted chain line shown in FIG. 1 and the sheets P come in press contact with the sheet feeding roller 103.

A movement of the load receiving member 135 can be adjusted by slightly changing the relation among values of the above distances L1, L2, L3 and L4. Namely, for example, a vertical moving amount of a rear end portion of the load receiving member 135 is larger than that of a leading end portion of the load receiving member 135 when setting the relation to L1<L2 or L3<L4. Accordingly, a locus of the load receiving member 135 can be set in conformity with an individual design condition such as a restriction of space.

An operation of the middle plate will next be explained in a situation in which sheets of respective sizes are stacked.

When sheets P of a standard size are fully stacked onto the middle plate 131, the weight of the sheets P is approximately uniformly distributed in the leading end side supporting portion 131*b* and the rear end side supporting portion 131*a* of the middle plate 131. Namely, a load applied to the rear end side supporting portion 131*a* of the middle plate 131 is applied to the connecting shaft 136*c* of the load receiving member 135 and the middle plate 131, so that the load receiving member 135 begins to be moved downward in parallel. Thus, moment for rotating the load transmitting member 132 in the counterclockwise direction is generated. This moment gives force in a pushing-up direction of a leading end portion of the middle plate 131.

In contrast to this, the weight of the sheets P applied to the leading end side supporting portion 131*b* of the middle plate 131 acts as moment for rotating a leading end of the middle plate 131 in a pushing-down direction. These two moments are applied in a mutual canceling direction, thereby reducing the difference in force for pushing down the leading end of the middle plate 131 by a sheet bundle due to a difference in density of the sheets P. Accordingly, variation in sheet feeding pressure based on the weight of the sheets P stacked on the middle plate 131 can be suppressed to a small range.

When the sheets P of a small size are fully stacked, force for pushing down the leading end side supporting portion 131*b* by the sheets P is reduced by reducing the weight of the sheets P. However, the center of gravity of the sheet bundle is simultaneously moved onto a leading end side in the paper passing direction. Accordingly, a load distributed to the leading end side supporting portion 131*b* and the rear end side supporting portion 131*a* begins to be largely applied to the leading end side supporting portion 131*b*. Therefore, force for rotating the leading end side supporting portion 131*b* of the middle plate 131 in a pushing-up direction is reduced, so that variation in sheet feeding pressure is reduced. In this case, a ratio of loads applied to the leading end side supporting portion 131*b* and the rear end side supporting portion 131*a* is inversely proportional to a distance from a position of the center of gravity of the sheet bundle to the shaft 136*d* inserted into the leading end side supporting portion 131*b,* and a distance from that position to the connecting shaft 136*c* for pivotally supporting the rear end side supporting portion 131*a.* Accordingly, it is sufficient to set optimum positions of the leading end side supporting portion 131*b* and the rear end side supporting portion 131*a* by moving the rear end regulating member 138 in accordance with a sheet size for guaranteeing paper passage.

Conversely, since the elongated sheets P of such as legal size etc. have a length longer than the length of a sheet stacking face of the middle plate 131, the rear end portion of the sheets is placed on the plane portion 135*b* of the load receiving member 135. In such a construction, the weight of a portion of the elongated sheets P which sticks out from the sheet stacking face is applied in a pushing-up direction of the leading end side supporting portion 131*b,* and the sheet feeding pressure is increased in comparison with the sheet P of a standard size. However, since no thin paper is generally used in the elongated sheets P, there is no fear of double feeding and no serious problem is caused.

The weight of sheets P is mutually canceled by the leading end side supporting portion 131*b* and the rear end side supporting portion 131*a* of the middle plate 131 by constructing the load transmitting member 132, the load receiving member 135, the arm member 133 and the middle plate 131 as mentioned above. Accordingly, variation in the sheet feeding pressure due to sizes and densities of the sheets P can be restrained.

Further, the middle plate 131 and the weight of a sheet bundle are supported in two highly rigid portions by arranging the shaft 134*a* of the load transmitting member 132 and the shaft 134*b* of the arm member 133 in relatively highly rigid portion of the side wall 130*b.* Accordingly, a movement of the middle plate 131 can be stabilized.

Further, since positions of the shafts 134*a,* 134*b* can be located downward, a height of the side wall 130*b* of the sheet feeding tray 130 can be lowered so that a large amount of sheets P can be easily put in and out.

Since no middle plate 131 is directly supported by the main body 130*a* of the sheet feeding tray 130, the width regulating member 139 having a sufficient length in the paper passing direction can be arranged. Accordingly, a slanting movement of the sheets P is restrained, so that printing accuracy can be improved.

Further, the length of the middle plate 131 is set to a length close to a standard sheet size in the paper passing direction, and a rear end of the elongated sheets is placed onto the load receiving member 135. Accordingly, it is not necessary to deepen a bottom portion of the main body 130*a* of the sheet feeding tray 130 for the elongated sheets P. The rear end regulating member 138 is also arranged on the load receiving member 135. Accordingly, vertical moving range of the rear end regulating member 138 does not change even when the rear end regulating member 138 is set in conformity with the sheets P of any size. Therefore, it is not necessary to save a space for avoiding abuttal between the upper end of the rear end regulating member 138 and a laser beam printer, so that the space can be effectively utilized.

What is claimed is:

1. A sheet feeding apparatus comprising:

a first supporting member for supporting a leading end side of a stack of sheets in a sheet feeding-out direction;

a second supporting member for supporting a trailing end side of the stack of sheets in the sheet feeding-out direction, said second supporting member supported in a manner different from said first supporting member;

sheet feeding means arranged on a leading end side in the sheet feeding-out direction of said first supporting member, for feeding out the sheets supported by said first supporting member; and load transmitting means for converting a load of the sheets applied to said second supporting member to a biasing force for biasing a leading end side of said first supporting member toward said sheet feeding means.

2. A sheet feeding apparatus according to claim 1, said load transmitting means including:

moving means for moving said second supporting member in accordance with the load of the sheet supported by said sheet stacking means; and engaging means engaged with both said first and second supporting members, for transmitting a displacement of said second supporting member moved by said moving means to said first supporting member and converting this displacement to biasing force for biasing said first supporting member.

3. A sheet feeding apparatus according to claim 2, wherein said first supporting member is rotated by a rotating shaft arranged along a width direction of the sheet and a leading end side of said first supporting member is biased toward said sheet feeding means, said engaging means is a connecting joint for rotatably connecting said first and second supporting members, said moving means is link means coupled to said second supporting member and a fixedly supporting portion respectively at two rotating fulcrums apart from each other in the sheet feeding direction so as to continuously connect said second supporting member to the fixedly supporting portion, and the load of the sheet stacked on said second supporting member is transmitted by said link means as biasing force for rotating said first supporting member through said connecting means.

4. A sheet feeding apparatus according to claim 2, wherein said first supporting member is rotated by a rotating shaft arranged along a width direction of the sheet and a leading end side of said first supporting member is biased toward said sheet feeding means, said moving means comprises a plurality of link means which are coupled to said second supporting member and a fixedly supporting portion respectively at two rotating fulcrums apart from each other in the sheet feeding direction so as to continuously connect said second supporting member to the fixedly supporting portion and swingably hold said second supporting member and which are arranged along the sheet feeding direction, and the load of the sheet stacked on said second supporting member is transmitted by said plurality of link means as biasing force for rotating said first supporting member through said engaging means.

5. A sheet feeding apparatus according to claim 2, wherein said first supporting member is rotated by a rotating shaft arranged along a width direction of the sheet and a leading end side of said first supporting member is biased toward said sheet feeding means, said load transmitting means has engaging means for engaging said second supporting member with said first supporting member and slide means as moving means for moving said second supporting member so as to lower a position of the second supporting member as the second supporting member is moved in the sheet feeding direction, and the load of the sheet stacked in said second supporting member is transmitted by said slide means as biasing force for rotating said first supporting member through said engaging means.

6. A sheet feeding apparatus according to claim 1, further comprising:

a load transmitting member rotatably supported by the main body, for supporting the leading end side of said sheet stacking means so as to press the sheet against said sheet feeding means; and a load receiving member supported within the main body so as to be movable in parallel in a vertical direction, connected to said load transmitting member on a side opposed to a side for supporting said sheet stacking means, and rotatably connected to the rear end side of the sheet stacking means;

wherein rotating moment in a direction for biasing the sheet toward said sheet feeding means is generated on the leading end side of the sheet stacking means by said load transmitting member and said load receiving member, by utilizing the load of the sheet supported by said sheet stacking means.

7. A sheet feeding apparatus according to claim 6, wherein said load transmitting member rotatably supports axially an intermediate portion in a side wall on the leading end side of the main body in the sheet feeding direction and the leading end side of said sheet stacking means is rotatably supported at one end of said load transmitting member, and said load receiving member is erected to the other end of said load transmitting member and an arm member rotatably supported axially at a side wall on the rear end side of the main body in the sheet feeding direction and is movably supported by the load transmitting member and the arm member.

8. A sheet feeding apparatus according to claim 6, wherein a rear end regulating member for regulating a rear end position of the sheet stacked on said sheet stacking means is arranged movably in the sheet feeding direction on said load receiving member.

9. A sheet feeding apparatus according to claim 1, wherein said sheet feeding means has a fan-shaped roller.

10. A sheet feeding apparatus according to claim 9, wherein a separating pad for separating sheets is arranged oppositely to said fan-shaped roller, and a roller for separating said fan-shaped roller and said separating pad when a notch portion of said fan-shaped roller opposes to said separating pad is arranged on the same axis as said fan-shaped roller.

11. A sheet feeding apparatus according to claim 1, wherein said biasing force is applied by a coil spring.

12. An image forming apparatus comprising:

a first supporting member for supporting a leading end side of a stack of sheets in a sheet feeding-out direction;

a second supporting member for supporting a trailing end side of the stack of sheets in the sheet feeding-out direction, said second supporting member supported in a manner different from said first supporting member;

sheet feeding means arranged on a leading end side in the sheet feeding-out direction of said first supporting member; and load transmitting means for converting a load of the sheets applied to said second supporting member to a biasing force for biasing a leading end side of said first supporting member toward said sheet feeding means; and image forming means for forming an image on the sheet fed out by said sheet feeding means.

* * * * *

UNITED STATES PATENT AND TRADEMARK OFFICE

CERTIFICATE OF CORRECTION

PATENT NO. : 6,357,740 B1
DATED : March 19, 2002
INVENTOR(S) : Ryukichi Inoue et al.

It is certified that error appears in the above-identified patent and that said Letters Patent is hereby corrected as shown below:

Column 8,
Line 22, “but.” should be deleted.

Column 16,
Line 9, “opposes” should read -- opposed --.

Signed and Sealed this

Third Day of September, 2002

*Attest:*

*Attesting Officer*

JAMES E. ROGAN
*Director of the United States Patent and Trademark Office*